United States Patent [19]

Feiler

[11] Patent Number: 4,993,545

[45] **Date of Patent: * Feb. 19, 1991**

[54] UNITARY ANGLED RING DISPLAY SYSTEM

[76] Inventor: Robert J. Feiler, c/o Morel Jewel Displays, Inc., 517 W. 29th St., New York, N.Y. 10001

[ * ] Notice: The portion of the term of this patent subsequent to Apr. 17, 2007 has been disclaimed.

[21] Appl. No.: 413,092

[22] Filed: Sep. 27, 1989

Related U.S. Application Data

[63] Continuation-in-part of Ser. No. 241,890, Sep. 8, 1988, Pat. No. 4,917,235, which is a continuation-in-part of Ser. No. 231,359, Aug. 12, 1988, Pat. No. 4,913,289.

[51] Int. Cl.[5] ..... B65D 6/04

[52] U.S. Cl. ..... 206/6.1; 206/45.14; 206/566

[58] Field of Search ..... 206/6.1, 45.14, 301, 206/566, 486, 490, 477, 480, 483

[56] References Cited

U.S. PATENT DOCUMENTS

| | | | |
|---|---|---|---|
| D. 101,753 | 10/1936 | Nathanson | 206/566 |
| 1,289,193 | 12/1918 | Kline | 206/566 |
| 1,305,241 | 5/1919 | Hendry | 206/566 |
| 1,456,613 | 5/1923 | Bartels | 206/566 |
| 2,144,968 | 1/1939 | Gerth | 206/566 |
| 2,883,048 | 4/1959 | Lentz | 206/566 |
| 3,942,632 | 3/1976 | Witkoff | 206/566 |
| 4,300,674 | 11/1981 | Davit | 206/45.14 |
| 4,448,304 | 5/1984 | Weinzettel et al. | 206/566 |
| 4,646,920 | 3/1987 | Kruger | 206/566 |
| 4,913,289 | 4/1990 | Feiler | 206/566 |
| 4,917,235 | 4/1990 | Feiler | 206/45.14 |

FOREIGN PATENT DOCUMENTS

| | | | |
|---|---|---|---|
| 1270424 | 10/1960 | France | 206/566 |
| 847969 | 9/1960 | United Kingdom | 206/566 |

*Primary Examiner*—David T. Fidei
*Attorney, Agent, or Firm*—Edward Callahan

[57] ABSTRACT

A ring display system for showing rings on a shelf of a showcase. The display system comprises a support structure, which includes a first flat surface having a first plurality of ring slots for mounting a first plurality of the rings and a second flat surface angled relative to the first flat surface and having a second plurality of ring slots for mounting a second plurality of the rings. The support structure is movable between first and second display positions, the first display position being when the first flat surface is oriented facing upward and angled toward customers for viewing and the second flat surface is oriented facing downward. The second display position is when the second flat surface is oriented facing upward and angled toward customers for viewing and the first flat surface is oriented facing downward. In the first display position the second flat surface is positioned on the generally horizontal shelf surface and the first flat surface means is aligned with a flat plane which defines a first angle with the generally horizontal shelf surface. In the second display position the first flat surface is positioned on the generally horizontal shelf surface and the second flat surface is aligned with a flat plane which defines a second angle with the generally horizontal shelf surface. The first and second flat surfaces can be configured in various geometrical configurations.

30 Claims, 12 Drawing Sheets

72
122A
96
110A
70
114
96
72
90
110A
70
68
108A
98
108A
108A
106
106
106
106
108B
122B
108B
108B
88
64
110B
76
116
76
110B
76
74
78

UNITARY ANGLED RING DISPLAY SYSTEM

CROSS-REFERENCES TO RELATED APPLICATIONS

This application is a continuation-in-part of an application entitled "Unitary Ring Display System", application Ser. No. 241,890, filed Sept. 8, 1988, now U.S. Pat. No. 4,917,235, which in turn is a continuation-in-part of an application entitled "Unitary Watch Display System", application Ser. No. 231,359, filed Aug. 12, 1988, now U.S. Pat. No. 4,913,289.

FIELD OF THE INVENTION

This invention relates generally to the art of jewelry display for retail sale and more specifically to the art of ring display.

BACKGROUND OF THE INVENTION

The art of jewelry display relates to the showing of certain precious commodities in a glass showcase to customers for retail sale purposes. Watches and rings are considered to be among the commodities shown in this manner.

Sales of jewelry including rings increase and decrease sharply in accordance with particular seasons of the year. In particular, during the Christmas season when customer demand is strong, a large number of rings are in inventory and many are displayed in showcases by retailers. Immediately after Christmas, customer demand drops precipitously and merchandise levels are kept low.

Rings displayed for retail sale in a glass showcase are mounted on "trims", which include (1) "elevations", also known as "buildups" or "steps" and (2) the components that hold the actual rings, which in turn rest on the elevations. The elevations rest on the floor of the glass showcase. A number of elevations are positioned adjoining one another. An easel, or tilt support, is generally placed under the elevation at its rear edge so as to present the elevation to customers at a slant. The easels are generally of slightly different sizes so that the elevations are presented at different angular slants. A first type of elevation used for rings in seasons of high merchandise levels has a topside and a back side. The topside is a level platform covered with a fabric and having a number of ring slots for mounting rings in the season of high merchandise level. The back side has no function and is provided with a backing, generally of paper, which covers over the edges of the fabric covering of the elevation. Because merchants want to avoid having a number of empty ring slots in the seasons of low merchandise levels, a second type of elevation is used. The second type of elevation also has a level topside covered in fabric and has a number of ring slots fewer in number than the topside of the first type of elevation. Like the first type of elevation, the second type of elevation has a backside having no function and provided with a backing, generally of paper, which covers over the edges of the fabric. The second type of elevation has fewer ring slots and thus presents fewer rings than the first type of elevation, although the elevation has all the ring slots filled with rings. Thus, the retailer is able to show an artful display of rings at times of both high and low merchandise levels. The problem with this system is that two completely different sets of elevations are needed by merchants over the course of a year with all the attendant problems the common two set operation entails.

A unitary ring display system described in application Ser. No. 241,890 overcomes the disadvantages of the problems of the two set elevation system just described by having a unitary support structure having opposed first and second platforms each having a different number of ring slots provided. The support structure is best shown tilted toward the customer. In application Ser. No. 241,890 this is accomplished by the support structure raised at the far side by a tilt means or by having the support structure mounted in a housing that tilts the support structure. Alternatively, an easel under the support structure tilts the display at an angle.

SUMMARY OF THE INVENTION

Accordingly, it an object of this invention to provide a unitary ring display system which provides the capability of showing either a high or a low level of ring inventory at a viewing angle relative to customers without disturbing the overall display environment;

It is another object of this invention to provide a unitary ring display system which can be used for times of both high and low merchandise levels and can be shown tilted relative to customers;

It is yet another object of this invention to provide a unitary ring display unit which is unitary and is angled relative to customers and which can be turned over when one side of the unit is worn and an unworn side be presented to the public.

In accordance with these an other objects that will become apparent in the course of this disclosure, there is provided a unitary angled ring display system for showing rings on a generally horizontal shelf surface of a showcase. The unitary angled ring display system includes a support structure, which in turn includes a first display platform, or first flat surface, having a first plurality of ring slots for mounting a first plurality of the rings and a second display platform, or second flat surface, angled relative to the first flat surface and having a second plurality of ring slots for mounting a second plurality of the rings. The support structure is movable between first and second display positions, the first display position being when the first flat surface is oriented facing upward and angled toward customers for viewing and the second flat surface is oriented facing downward. The second display position is when the second flat surface is oriented facing upward and angled toward customers for viewing and the first flat surface is oriented facing downward. In the first display position the second flat surface is positioned on the generally horizontal shelf surface and the first flat surface means is aligned with a flat plane which defines a first angle with the generally horizontal shelf surface. In the second display position the first flat surface is positioned on the generally horizontal shelf surface and the second flat surface is aligned with a flat plane which defines a second angle with the generally horizontal shelf surface. The first and second flat surfaces can be configured in various geometrical configurations. The first and second angles can be equal or not.

The present invention will be better understood and the objects and important features, other than those specifically set forth above, will become apparent when consideration is given to the following details and description, which when taken in conjunction with the annexed drawings, describes, discloses, illustrates, and shows preferred embodiments or modifications of the present invention and what is presently considered and believed to be the best mode of practice in the principles thereof.

Other embodiments or modifications may be suggested to those having the benefit of the teachings therein, and such other embodiments or modifications are intended to be reserved especially as they fall within the scope and spirit of the subjoined claims.

DESCRIPTION OF THE PREFERRED EMBODIMENT

Reference is now made in detail to the drawings wherein the same numerals refer to the same or similar elements throughout.

Figure 1:
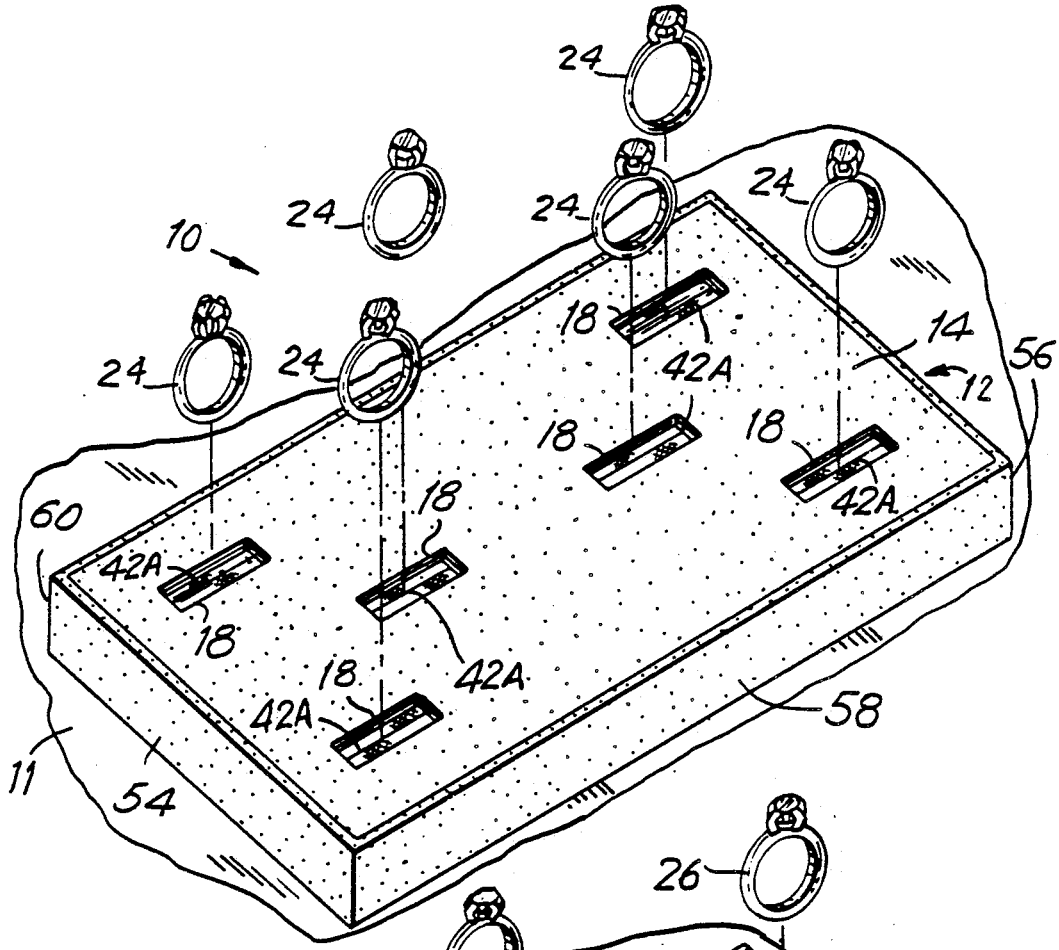
FIG. 1 is a top view of a first platform of a ring display system having a support structure as described in application Ser. No. 241,890.
Figure 2:
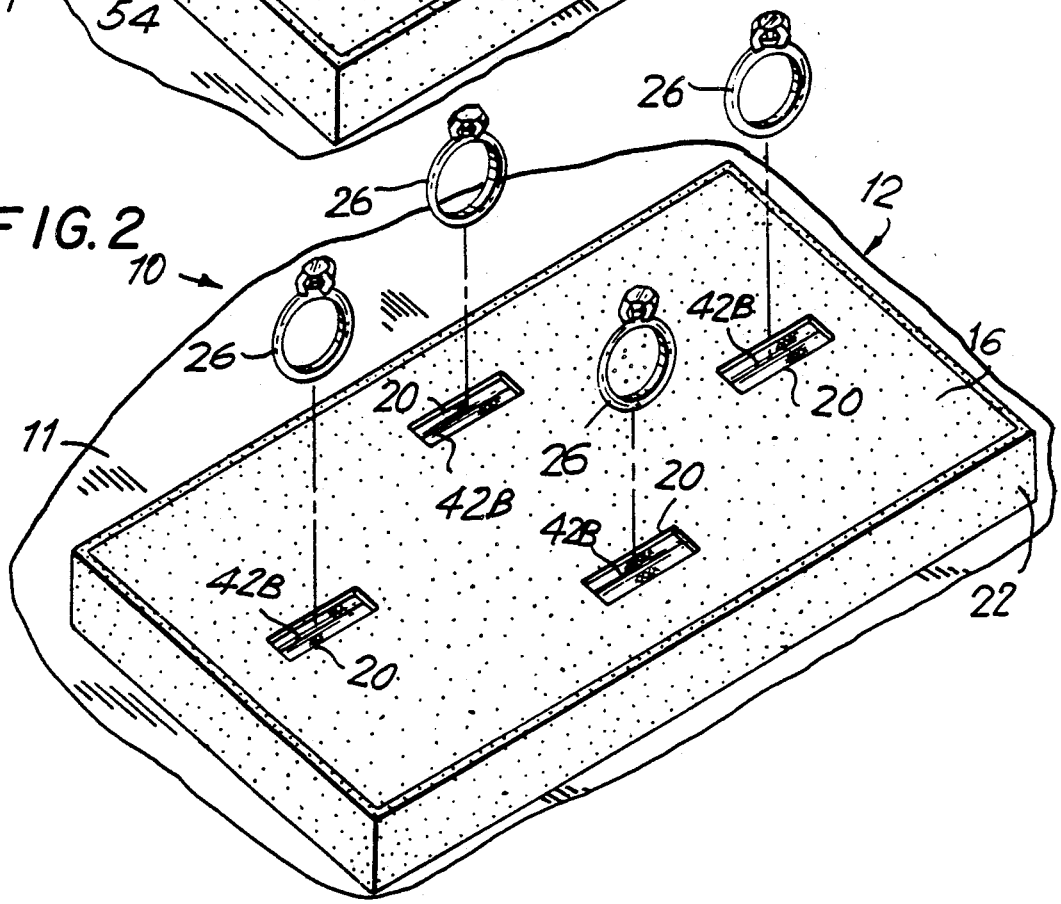
FIG. 2 is a top view of a second platform of the ring display system having the support structure shown in FIG. 1.
Figure 3:
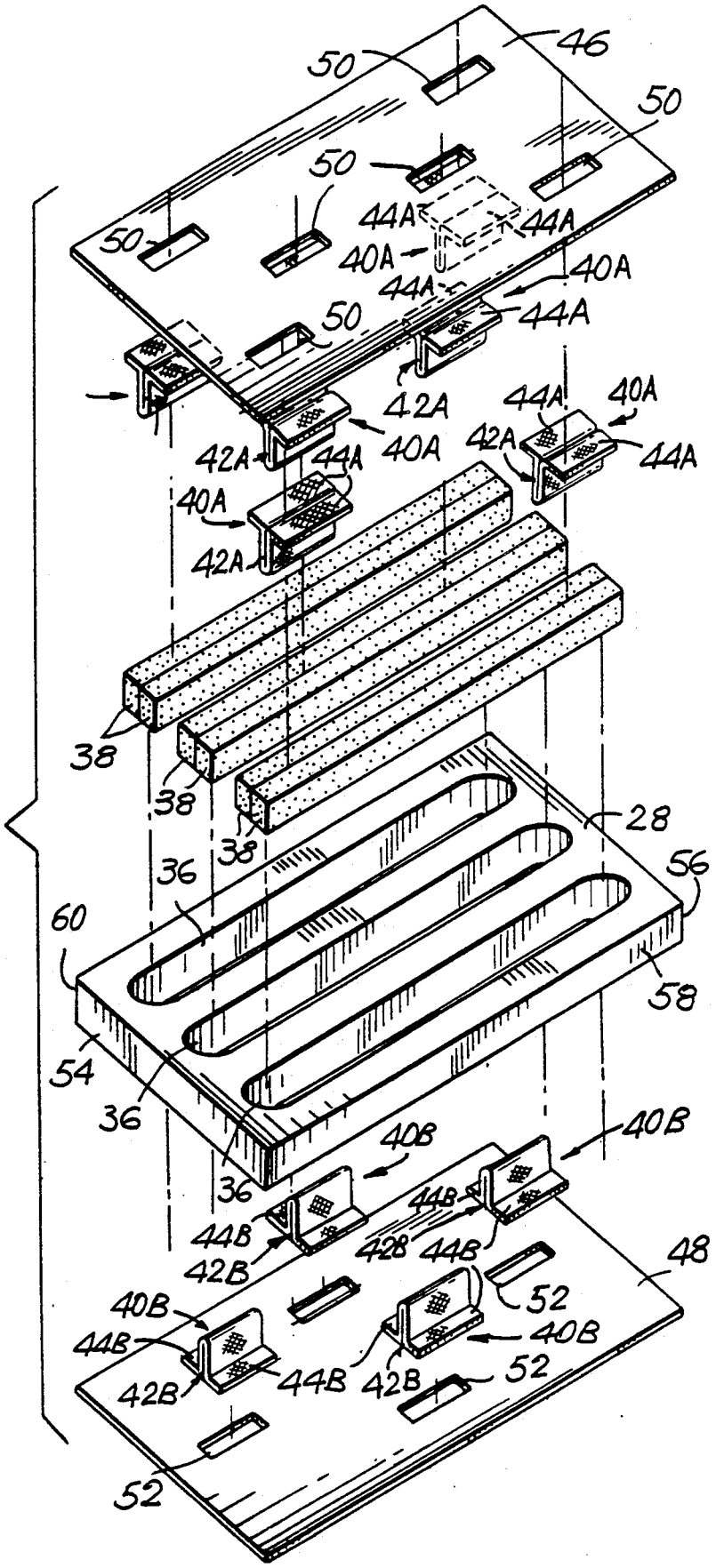
FIG. 3 is an exploded perspective view of the ring display system shown in FIGS. 1 and 2 with the first platform shown in an upward position without a covering fabric.
Figure 4:
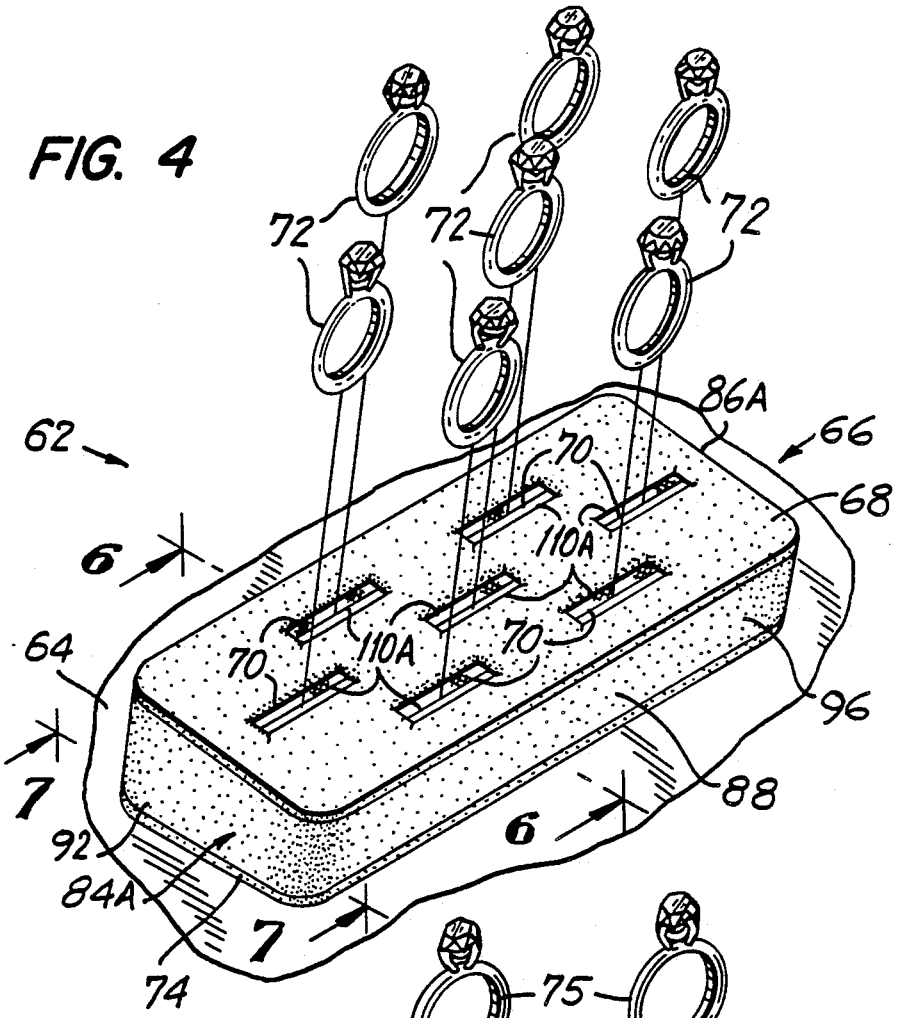
FIG. 4 is a perspective view of a unitary angled ring display system according to the present invention with a first platform being in a viewing position angled relative to customers.
Figure 5:
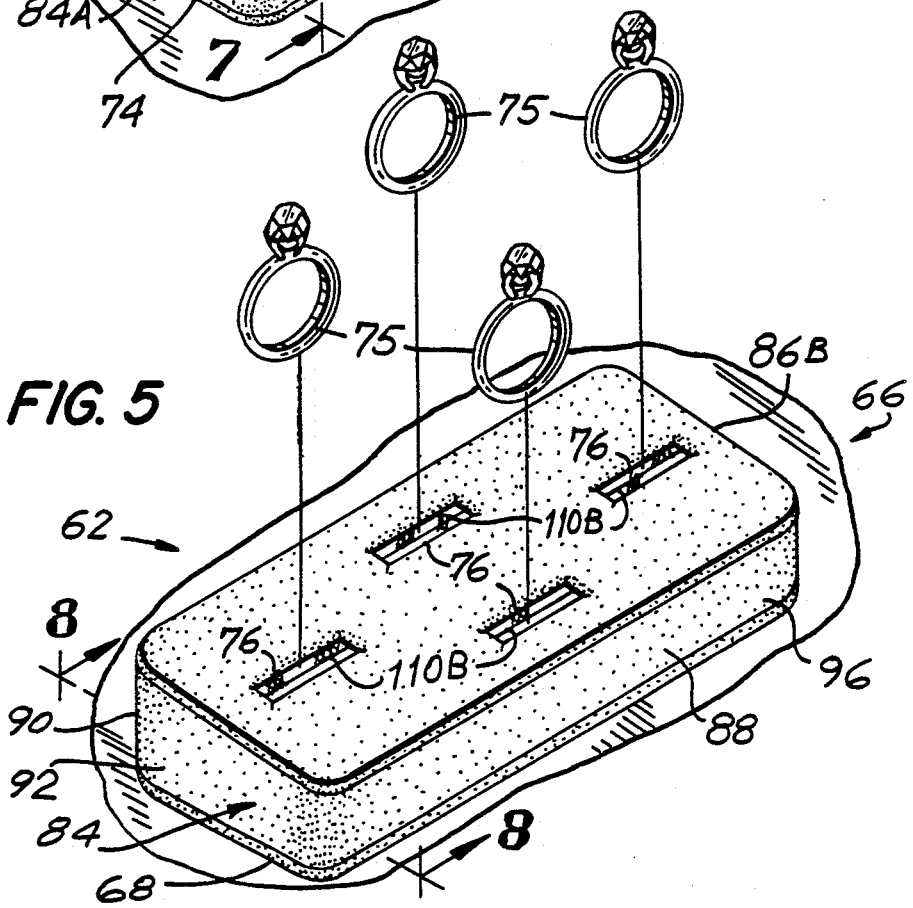
FIG. 5 is a perspective view of the unitary angled ring display system shown in FIG. 4 with a second platform being in a viewing position angled relative to the customers.

A unitary ring display system 10 disclosed in patent application Ser. No. 241,890 is illustrated in FIGS. 1, 2, and 3. Unitary ring display system 10 is positioned on a generally horizontal shelf surface 11. Unitary ring display system 10 includes a support structure 12 configured as a parallelepiped which includes opposed rectangular flat parallel first and second platforms, or first and second flat surfaces, 14 and 16, respectively, which have first and second sets of ring slots 18 and 20, respectively. First flat surface 14 includes six first ring slots opening at first flat surface 14, and second flat surface 18 includes four ring slots 20 opening at second flat surface 16. The number of ring slots in each surface is for purposes of exposition only and can vary in accordance with varying demands of the jewelry display industry. A decorative fabric 22 covers support structure 12. Fabric 22 has openings that define the openings of the long dimensions, or lengths, and the widths of first and second ring slots 18 and 20. The lengths of first and second ring slots 18 and 20 are ordinarily oriented generally transverse to the line of sight of a viewer spaced in a regular pattern. Six rings 24 are illustrated raised over first flat surface 14 in preparation for mounting in first ring slots 18, and four rings 26 are illustrated raised over second flat surface 16 in preparation for mounting in second ring slots 20. Support structure 12 is movable by a retailer to either a high, or full, ring display position or a reduced, or partial ring display position. The full ring display position is when first flat surface 14 is oriented facing upward and second platform or second flat surface, 16 is oriented facing downward upon shelf surface 11 as illustrated in FIG. 1. The reduced ring display position is when second platform, or second flat surface, 16 is oriented facing upward and first platform, or first flat surface, 14 is oriented facing downward upon shelf surface 11 as illustrated in FIG. 2. Thus, support structure 12 can be selectively reversed in its position in accordance with either high or reduced merchandise levels, which are in turn seasonal in the jewelry retail field. Support structure 12 is reversed in position by its being manually lifted from shelf surface 11 of the display case in which it is positioned, rotated to its opposite position, and then reset on shelf surface 11. Support structure 12 is shown in exploded perspective in FIG. 3 with fabric 22 not shown. Support structure 12 includes a fixture, or base, 28, which is configured as a parallelepiped and is preferably made of wood or plastic. Base 28 defines three parallel, equally spaced, elongated cutouts 36, which extend completely through base 28 with apertures at each first flat surface 14 and second flat surface 16. Cutouts 36 are defined by walls which are perpendicular to first and second flat surfaces 14 and 16 and are oriented generally transverse to the line of sight of a viewer and extend almost the entire width of base 28 to locations proximate to the transverse sides of base 28. A pair of slightly spaced, elongated, rectangular blocks 38 preferably made of a generally flexible fabric such as bengaline are positioned along the length of each cutout 36. Three biasable grips 40A preferably made of rubber generally T-shaped in cross-section having a separable generally vertical section are positioned in each cutout 36 between each pair of blocks 38. A gripping space 42A is formed in a generally vertical, separable section of each grip 40A with the opening of each gripping space 42A oriented to open at first flat surface 14 so that a gripping space area of gripping spaces 42A is accessible at each of first ring slots 18. In addition, three biasable grips 40B analogous to biasable grips 40A are likewise positioned in each cutout 36 between each pair of blocks 38 directly adjacent to biasable grips 40A. A gripping space 42B is formed in a generally vertical, separable section of each grip 40B with the opening of each gripping space 42B oriented to open at second flat surface 16 so that a gripping space area of gripping spaces 42A is accessible at each of second ring slots 20. First and second caps, or stiffening boards, 46 and 48, respectively, fitted to the dimensions of the opposed sides of base 28 that conform to first flat surface 14 and second flat surface 16, respectively, are positioned to cover the opposed sides of base 28. First board 46 has six rectangular first board slots 50 that conform with the placement of first ring slots 18; and second board 48 has four rectangular second board slots 52 that conform with the placement of second ring slots 20. The lengths and widths of first and second board slots 50 and 52 are coextensive with the lengths and widths of first and second ring slots 18 and 20. First and second boards 46 and 48 are made of a stiff, light material such as cardboard. Rings 24 are adapted to be mounted in first ring slots 18 in gripping spaces 42A at upward facing first flat surface 14 when the vertical sections are forced apart into a biased mode by rings 24; and likewise rings 26 are adapted to be mounted in second ring slots 20 in gripping spaces 42B at upward facing second flat surface 16 when the vertical sections are forced apart into a biased mode by rings 26. Generally horizontal connecting flaps 44A and 44B, which are the cross-bars of the T of biasable grips 40A and 40B, respectively, are positioned to overlie the outer surfaces of blocks 38 and to be in contact with a portion of the opposed outer surfaces of base 28 in the areas adjoining cutouts 36. Base 28 has a pair of opposed side walls 54 and 56 and opposed front and rear walls 58 and 60, respectively. Fabric 22, which can include such fabrics as velvet or faux suede, and which is connected to the outer surfaces of first and second boards 46 and 48 in a manner known in the art, for example, by gluing, covers the entirety of base 28 including side walls 54 and 56 and front and rear walls 58 and 60. Boards 46 and 48 cover and can be secured to connecting flaps 44A and 44B, respectively, of biasable grips 40A and 40B by a manner known in the art, for example, by gluing.

In accordance with the present invention, a unitary angled ring display system 62 for showing rings on a generally horizontal shelf surface 64 of a showcase is illustrated in FIGS. 4–8. Unitary angled ring display system 62 includes a support structure 66, which includes a first display platform, or first flat surface, 68 having a first plurality of ring slots shown for purposes of exposition as seven first ring slots 70 with it being understood that the number of ring slots can vary. First ring slots 70 are adapted to mount a first plurality of the rings shown as seven rings 72. Support structure 66 also includes a second display platform, or second flat surface, 74 having a second plurality of ring slots shown for purposes of exposition as four second ring slots 76 for mounting a second plurality of the rings shown as four rings 78.

Figure 7:
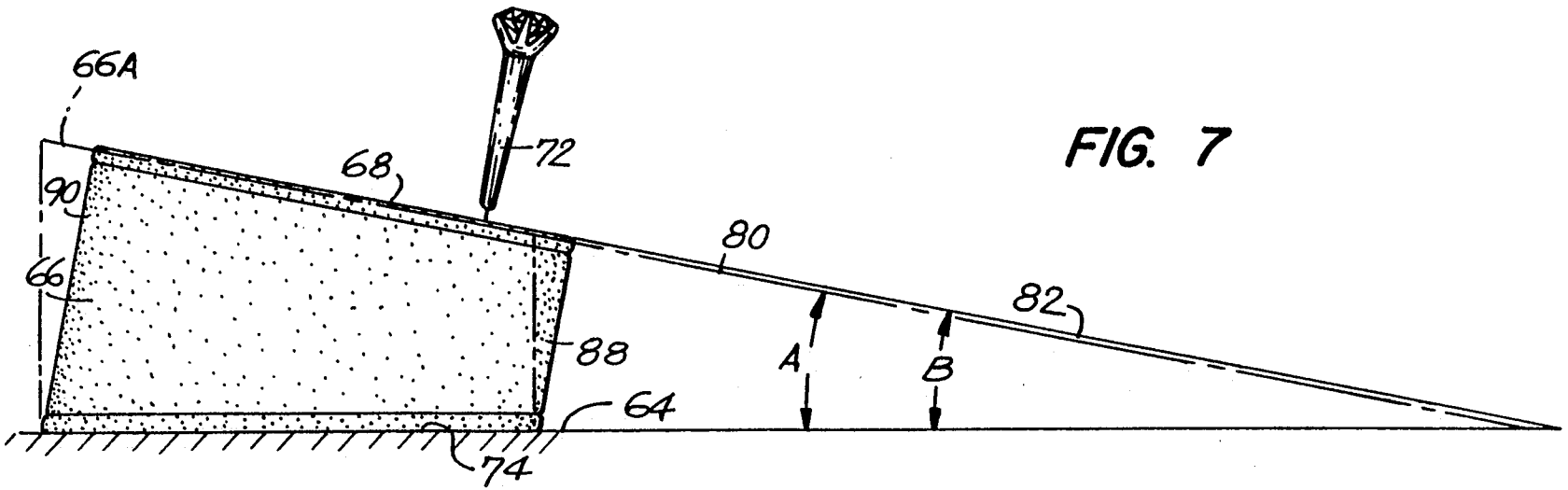
FIG. 7 is an elevation view taken through plane 7—7 in FIG. 4.
Figure 8:
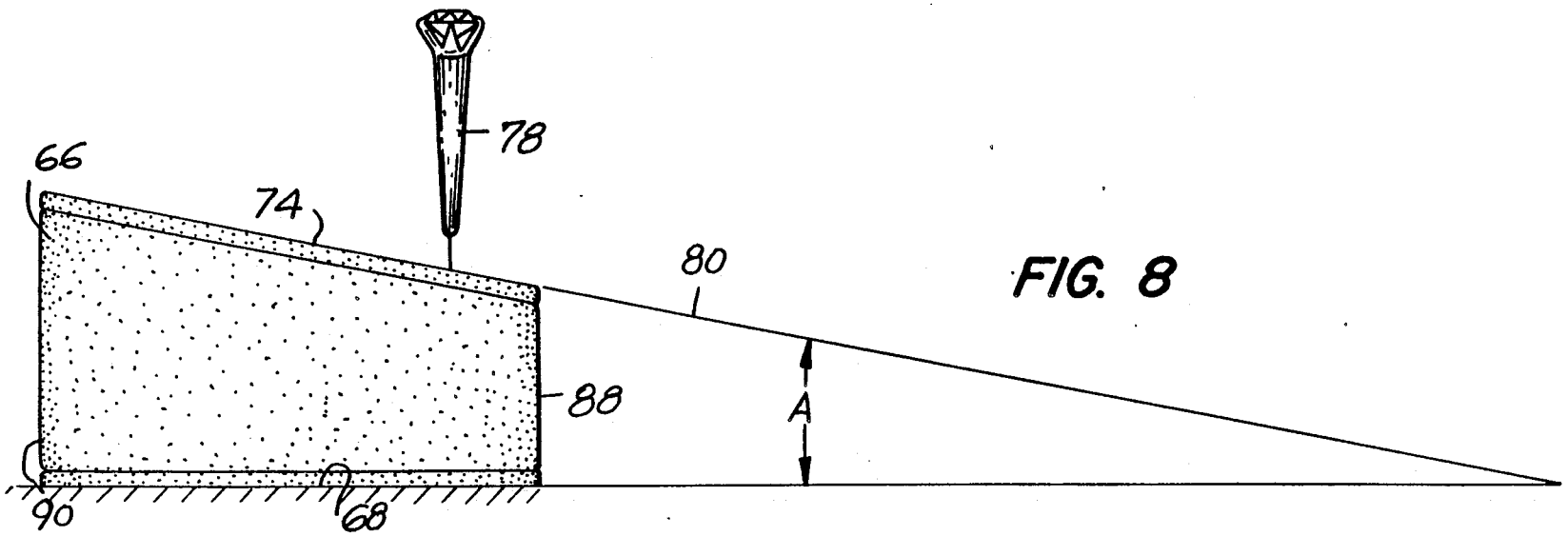
FIG. 8 is an elevation view taken through plane 8—8 in FIG. 5.

Support structure 66 is movable between first and second display positions, the first display position being when first flat surface 68 is oriented facing upward for viewing and second flat surface 74 is oriented facing downward, and the second display position being when second flat surface 74 is oriented facing upward for viewing and first flat surface 68 is oriented facing downward. As is illustrated in FIG. 7, in the first display position second flat surface 74 is positioned on shelf surface 64 and first flat surface 68 is aligned with a first flat plane 80 that defines a first angle A with shelf surface 64. As is illustrated in FIG. 8, in the second display position first flat surface 68 is positioned on shelf surface 64 and second flat surface 74 is aligned in a second flat plane 82 that defines a second angle B with shelf surface 64. Support structure 66 is indicated as support structure 66A in phantom line in FIG. 8 for the purpose of comparison.

Angle A and angle B are inclined in the direction of the lines of sight of customers, who are given an advantageous view of rings 72 or 78, depending on whether first or second flat surface 68 or 74 is being displayed.

Support structure 66 includes a continuous wall 84 joined to the edges 86A and 86B of first and second surfaces 68 and 74, respectively. Continuous wall 84 includes front and rear walls 88 and 90, respectively, with first and second surfaces 68 and 74 intersecting front and rear walls 88 and 90. First and second surfaces 68 and 74 are angled downward at first and second angles A and B from rear wall 88 to front wall 88 when support structure 66 is in the first or second display position, respectively. Continuous wall 84 also includes opposed left and right side walls 92 and 94, respectively, oriented to the left and right of a viewing customer. Front and rear walls 88 and 90 are parallel to one another and are configured as rectangles and are each oriented at right angles to first flat surface 68. First and second flat surfaces 68 and 74 are configured as rectangles having a long dimension extending between left and right side walls 92 and 94 and a short dimension extending between front and rear walls 88 and 90. As indicated by phantom line in FIG. 8, angles A and B are equal when front and rear walls 88 and 90 are both at right angles to either of first or second flat surfaces 68 or 74. Support structure 66 further includes a decorative fabric 96 covering the entire external surface of the support structure. Fabric 96 can be made of such fabrics as velvet or faux suede.

First and second ring slots 70 and 76 are of the same size and rectangular with long dimensions extending between left and right side walls 92 and 94 so that the planes of rings 72 and 78 likewise extend between left and right side walls 92 and 94, that is, the rings are displayed transverse to the lines of sight of customers viewing the rings.

Figure 6:
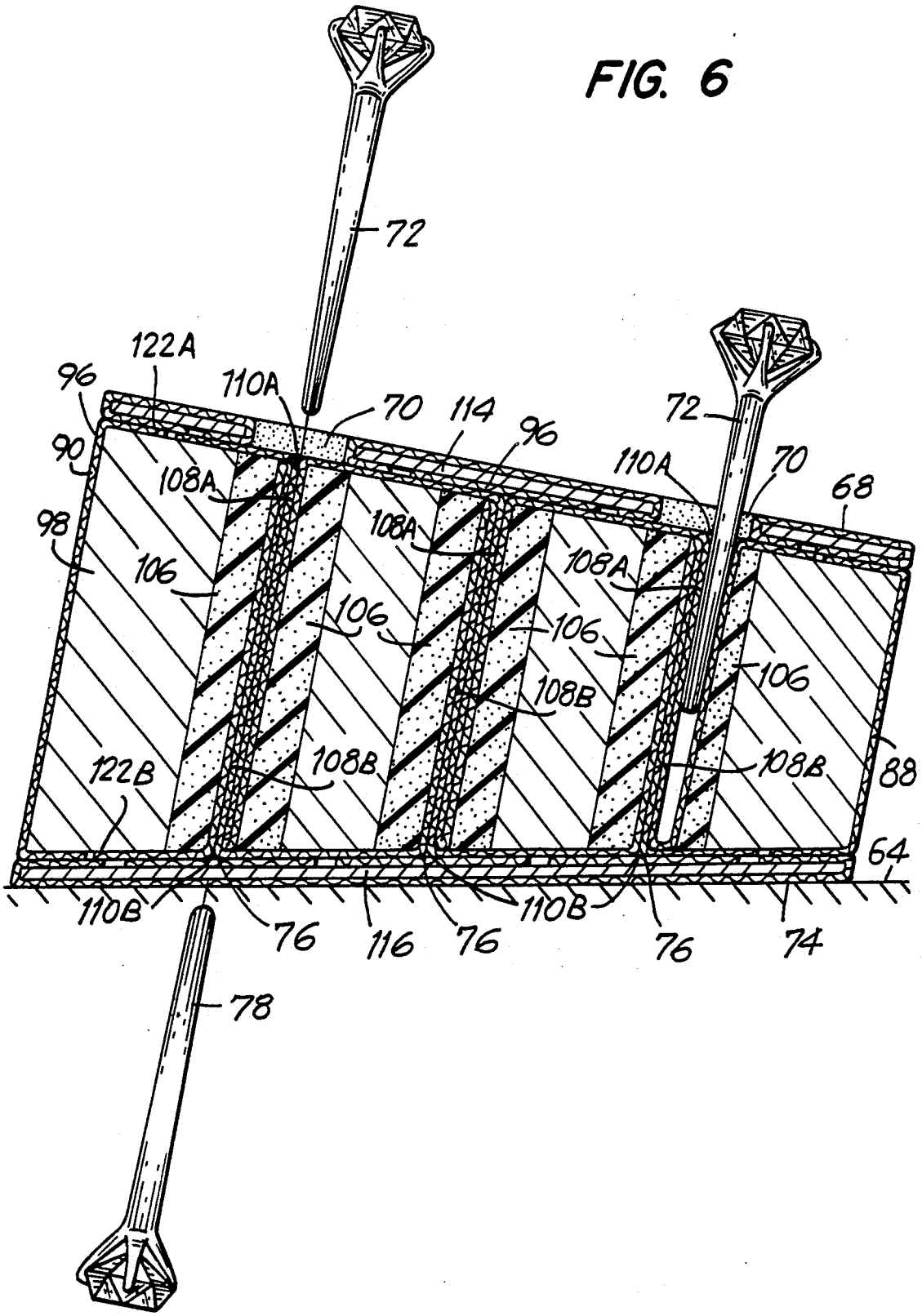
FIG. 6 is a sectional view taken through plane 6—6 in FIG. 4.
Figure 9:
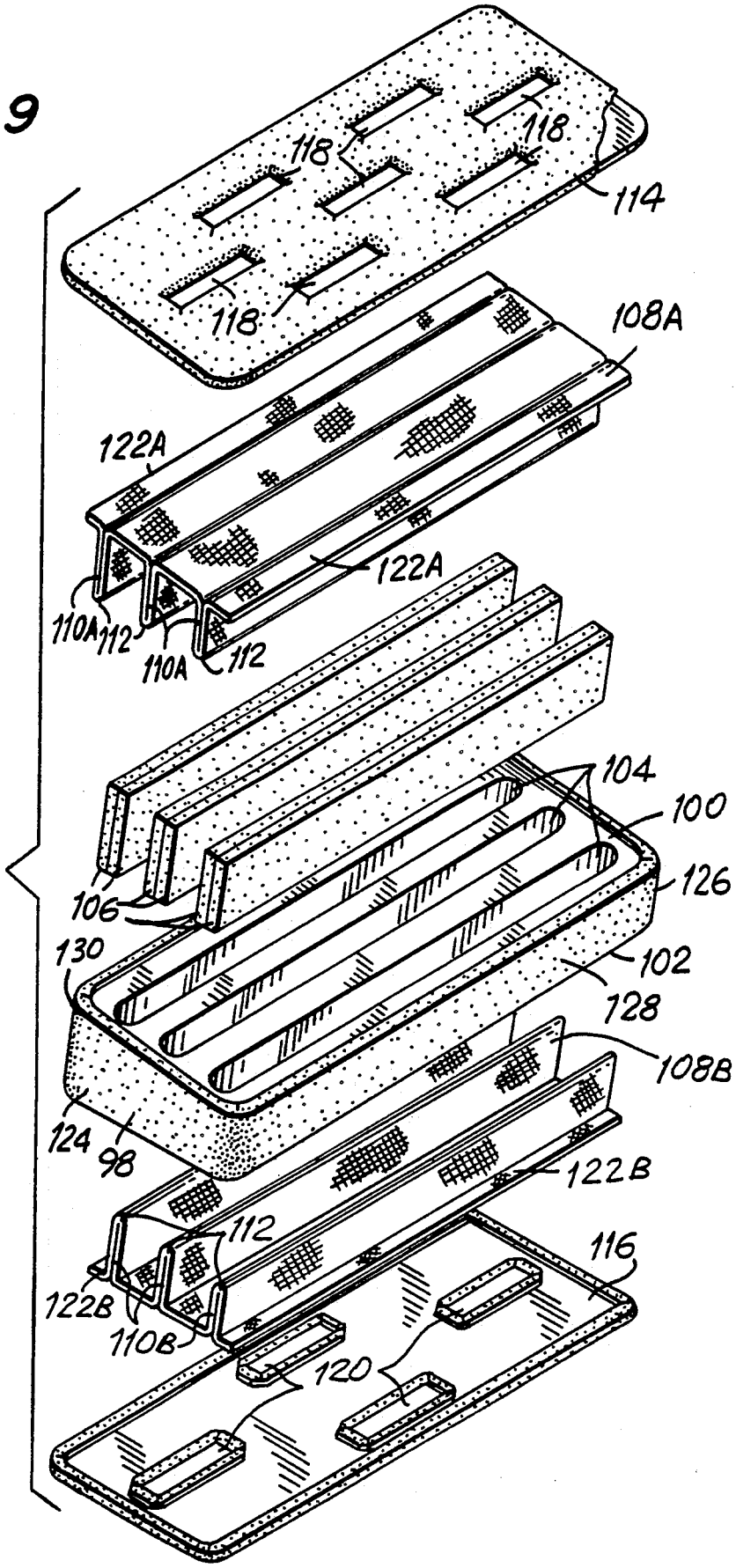
FIG. 9 is an exploded perspective view of the unitary angled ring display system shown in FIGS. 4 and 5 without the covering fabric.

FIGS. 6 and 9 illustrate the components of support structure 66 with fabric 96 not being included in FIG. 9. Support structure 66 includes a fixture, or base, 98 preferably made of wood or plastic having flat first and second sides 100 and 102, respectively, aligned with first and second flat surfaces 68 and 74, respectively, as previously described with reference to FIGS. 7 and 8.

Base 98 defines three parallel, equally spaced, elongated cutouts 104, which extend completely through base 98 with apertures at each first flat surface 68 and second flat surface 74. Cutouts 104 are defined by side walls 105 which are perpendicular to second flat surface 74 and define acute angles with first flat surface 68. First and second ring slots 70 and 76 are located coextensively with cutouts 104. Cutouts 104 are oriented generally transverse to the line of sight of a viewer and extend almost the entire width of base 98 to locations proximate to the transverse sides of base 98. A pair of slightly spaced, elongated, rectangular blocks 106 preferably made of a generally flexible fabric such as bengaline are positioned along the length of each cutout 104. Six biasable elongated gripping strips 108A and 108B preferably made of rubber and generally T-shaped in cross-section each having a separable generally vertical section are positioned in each cutout 104 between each pair of blocks 106. Gripping strips 108A and 108B are for removably holding rings 72 and 78, respectively, in first and second ring slots 70 and 76. Gripping strips 108A and 108B each includes a gripping space 110A and 110B capable of biasedly holding rings 72 and 78. Gripping strips 108A and 108B have inner sides defining gripping spaces 110A and 110B, respectively, located approximately midway through cutouts 104. Each biasable gripping strip 108A and 108B further includes a bottom wall 112 which acts to stop the movement of rings being mounted into first and second ring slots 70 and 76. The opening of each gripping space 110A and 110B passes in alignment with first and second flat surfaces 68 and 74 so that a gripping space area is accessible at each of first and second ring slots 70 and 76. Gripping strips 108A and 108B extend entirely through each of cutouts 104 in adjacent relationship with one another. First and second caps, or first and second stiffening boards, 114 and 116, respectively, fitted to the dimensions of first and second sides 100 and 102 of base 98 conform to first and second flat surfaces 68 and 74, respectively, are positioned to cover first and second sides 100 and 102. First board 114 has seven rectangular first board slots 118 that conform with the placement of first ring slots 70; and second board 116 has four rectangular second board slots 120 that conform with the placement of second ring slots 76. The lengths and widths of first and second board slots 118 and 120 are coextensive with the lengths and widths of first and second ring slots 70 and 76. First and second boards 114 and 116 are made of a stiff, light material such as cardboard or thin plastic. Rings 72 are adapted to be mounted in first ring slots 70 in gripping spaces 110A at upward facing first flat surface 68 when the vertical sections are forced apart into a biased mode by rings 72; and likewise rings 78 are adapted to be mounted in second ring slots 76 in gripping spaces 110B at upward facing second flat surface 146 when the vertical sections are forced apart into a biased mode by rings 78. Generally horizontal connecting flaps 122A and 122B, which are the cross-bars of the T of biasable gripping strips 108A and 108B, respectively, are positioned to overlie the outer surfaces of blocks 106 and to be in contact with a portion of the opposed outer surfaces of base 98 in the areas adjoining cutouts 104. Base 98 has a pair of opposed side walls 124 and 126 and opposed front and rear walls 128 and 129, respectively. Fabric 96, such as velvet or faux suede, which is connected to the outer surfaces of first and second boards 114 and 116 in a manner known in the art, for example, by gluing, covers the entirety of base 98 including side walls 124 and 126 and front and rear walls 128 and 129. First and second boards 114 and 116 cover and can be secured to connecting flaps 122A and 122B of biasable gripping strips 108A and 108B by a manner known in the art, for example, by gluing.

Support structure 66 is movable to either a full ring display position or a reduced ring display position, the full ring display position being when first flat surface 68 is oriented facing upward and second flat surface 74 is oriented facing downward; and the reduced ring display position being when second flat surface 74 is oriented facing upward and first flat surface is oriented facing downward.

As seen most clearly in FIGS. 7 and 8, in the first display position with first flat surface 68 oriented upward, rings 72 are displayed in slightly positions in the downslope direction, that is, toward the lines of sight of the customers. In the second display position with the second flat surface 74 oriented upward, rings 78 are displayed in upright positions. The rear rows of rings 78 are slightly greater in elevation than the more forward rows of rings 78. The difference in angles of rings 72 and 78 being displayed are in accordance with the side walls 105 of cutouts 104 being parallel with one another with rings 72 and 78 following the orientations of walls 105, which are as previously described perpendicular with second flat surface 74 and at acute angles with first flat surface 68.

The number of first ring slots 70 for first flat surface 68 can be the same as the number of second ring slots 76 for second flat surface 74. Such a configuration would allow a retailer to turn support structure 66 over when either first or second flat surface 68 or 74 becomes worn.

Support structure 66 in FIGS. 4–9 is configured as illustrated for purposes of exposition only and is shown only as one embodiment of various embodiments of the same unitary angled ring display system. FIGS. 10A–10D through FIGS. 20A–20D illustrate examples of other embodiments of support structure for unitary angled ring display systems in the spirit of the present invention. In FIGS. 10A–20D, rings in the first display position are indicated as rings 72 and rings in the second display position are indicated as rings 78 as so indicated in FIGS. 4–9.

Figure 10A:
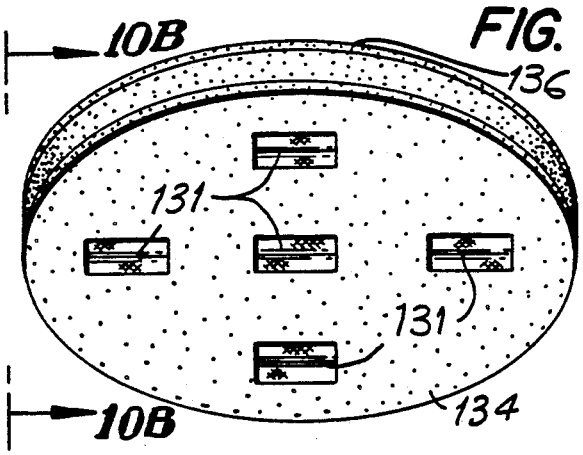
FIGS. 10A, 10B, 10C, and 10D show a unitary angled ring display system having first and second platforms configured as ovals.
Figure 10B:
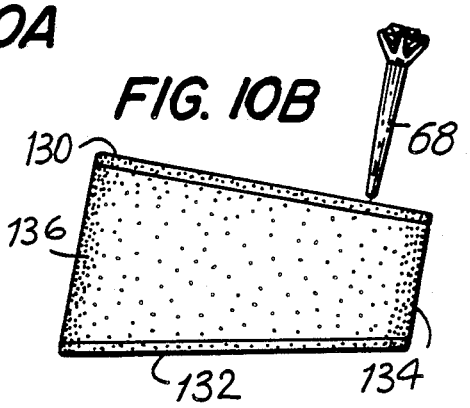
Figure 10C:
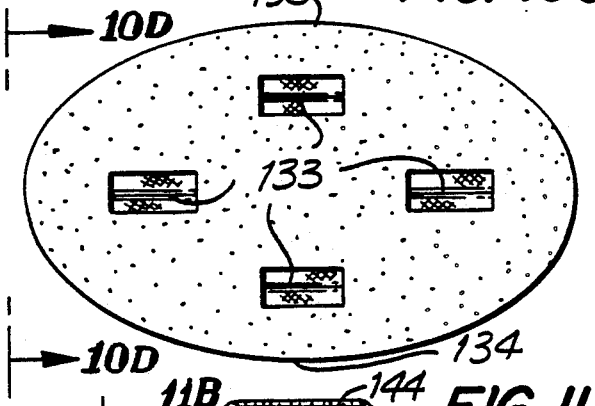
Figure 10D:
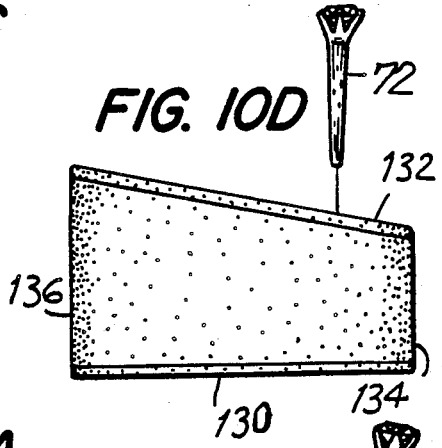

FIGS. 10A and 10C are top views of a first flat platform, or first flat surface 130 having five first ring slots 131 and a second flat platform, or second flat surface, 132 having four second ring slots 133. First and second flat surfaces 130 and 132 are configured as ovals of a unitary angled ring display system having front and rear walls 134 and 136, respectively. First and second flat surfaces 130 and 132 define angles analogous to angles A and B described with reference to first and second flat surfaces 68 and 74, respectively, of unitary angled ring system 62. Front and rear walls 134 and 136 shown in elevation views in FIGS. 10B and 10D are both at right angles to second flat surface 132. Cutouts of the base components are analogous to cutouts 104 of base 98 of FIG. 9, that is, the cutouts extend perpendicular to second flat surface 132 so that rings 72 are angled slightly forward from the vertical in the first display position and rings 78 are upright, or vertical, in the second display position.

Figure 11A:
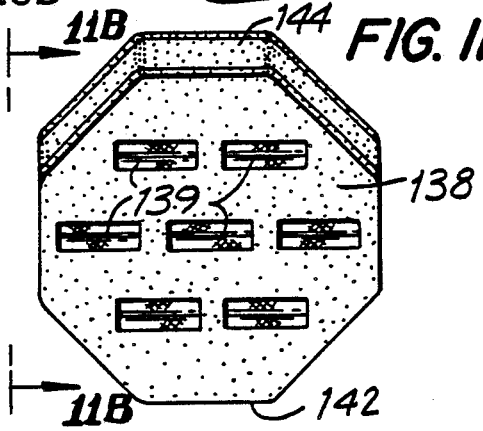
FIGS. 11A, 11B, 11C, and 11D show a unitary angled ring display system having first and second platforms configured as octagons.
Figure 11B:
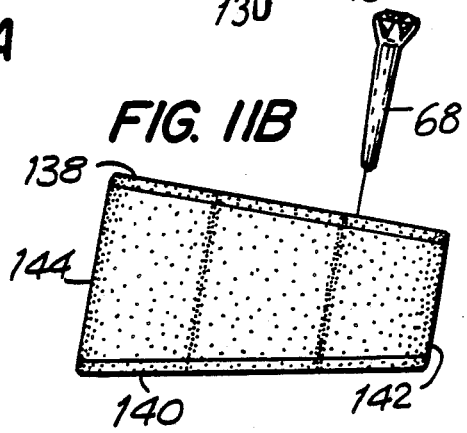
Figure 11C:
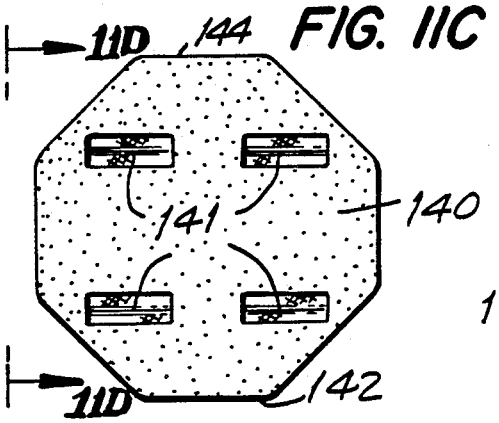
Figure 11D:
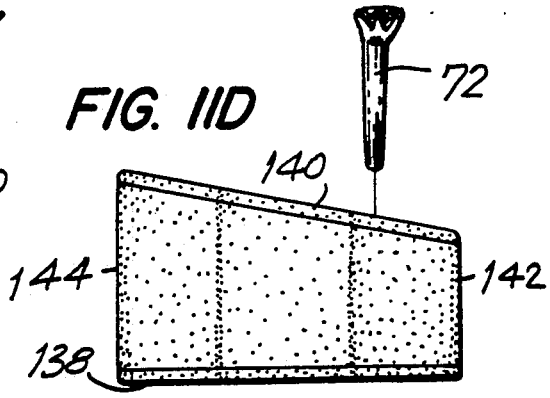

FIGS. 11A and 11C are top views of a first flat platform, or first flat surface, 138 having seven first ring slots 139 and a second flat platform, or second flat surface, 140 having four second ring slots 141. First and second flat surfaces 138 and 140 are configured as octagons of a unitary angled ring display system having front and rear walls 142 and 144, respectively. First and second flat surfaces 138 and 140 define angles analogous to angles A and B, respectively, described with reference to first and second flat surfaces 68 and 74, respectively, of unitary angled ring system 62. Front and rear walls 142 and 144 shown in elevation views in FIGS. 11B and 11D are both at right angles to second flat surface 140. Cutouts of the base components are analogous to cutouts 104 of base 98 of FIG. 9, that is, the cutouts of the embodiment of FIGS. 11A–11D extend perpendicular to second flat surface 140 so that rings 72 are angled slightly forward from the vertical in the first display position and rings 78 are upright, or vertical, in the second display position.

Figure 12A:
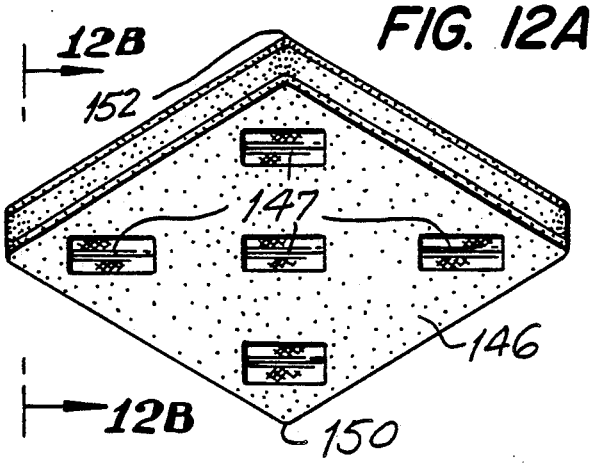
FIGS. 12A, 12B, 12C, and 12D show a unitary angled ring display system having first and second platforms configured as rhombuses.
Figure 12B:
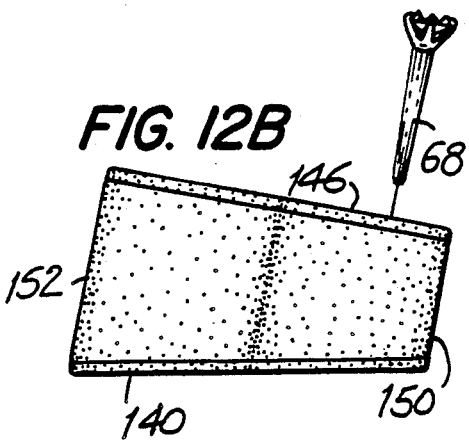
Figure 12C:
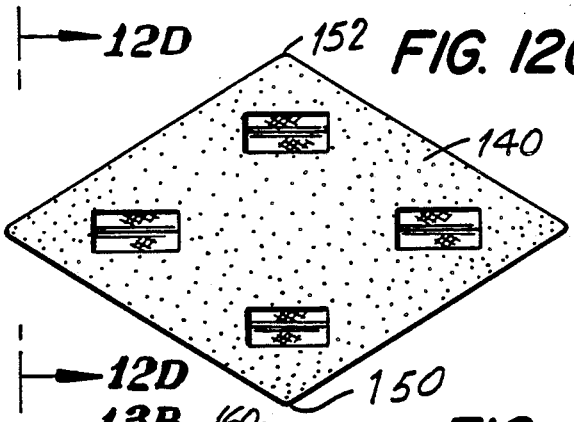
Figure 12D:
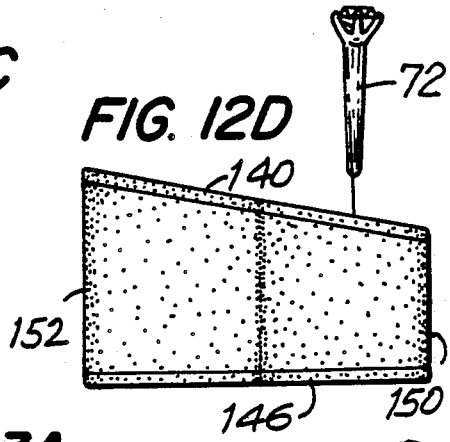

FIGS. 12A and 12C are top views of a first flat platform, or first flat surface, 146 having five first ring slots 147 and a second flat platform, or second flat surface, 148 having three second ring slots 149. First and second flat surfaces 146 and 148 are configured as rhombuses of a unitary angled ring display system. Front and rear edges 150 and 152, respectively, of the rhombuses extend between first and second flat surfaces 146 and 148, respectively, midway between the side edges of the rhombuses. First and second flat surfaces 146 and 148 define angles analogous to angles A and B, respectively, described with reference to first and second flat surfaces 68 and 74, respectively, of unitary angled ring system 62. Front and rear edges 150 and 152 shown in elevation views in FIGS. 12B and 12D are both at right angles to second flat surface 148. Cutouts of the base components are analogous to cutouts 104 of base 98 of FIG. 9, that is, the cutouts extend perpendicular to second flat surface 148 so that rings 72 are angled slightly forward from the vertical in the first display position and rings 78 are upright, or vertical, in the second display position.

Figure 13A:
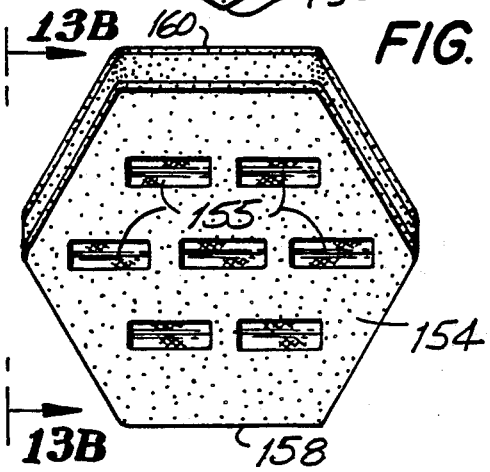
FIGS. 13A, 13B, 13C, and 13D show a unitary angled ring display system having first and second platforms configured as hexagons.
Figure 13B:
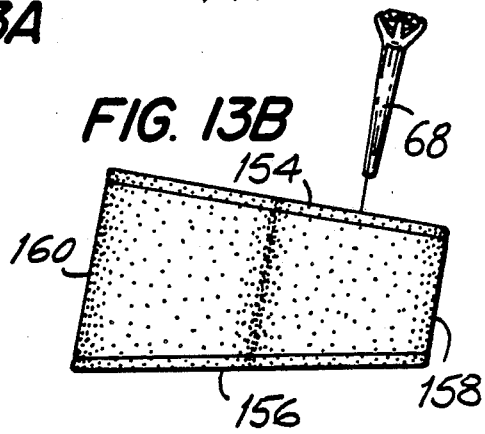
Figure 13C:
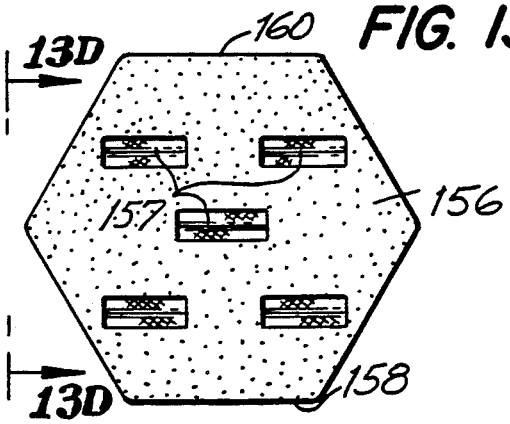
Figure 13D:
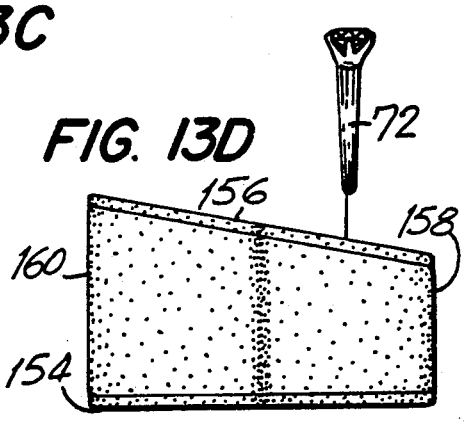

FIGS. 13A and 13C are top views of a first flat platform, or first flat surface, 154 having seven first ring slots 155 and a second flat platform, or second flat surface, 156 having five second ring slots 157. First and second flat surfaces 154 and 156 are configured as hexagons of a unitary angled ring display system having front and rear walls, 158 and 160, respectively. First and second flat surfaces 154 and 156 define angles analogous to angles A and B, respectively, described with reference to first and second flat surfaces 68 and 74, respectively, of unitary angled ring system 62. Front and rear walls 158 and 160 shown in elevation views in FIGS. 13B and 13D are both at right angles to second flat surface 156. Cutouts of the base components are analogous to cutouts 104 of base 98 and of FIG. 9, that is, the cutouts extend perpendicular to first and second flat surfaces 154 and 156, respectively, so that rings 72 are angled slightly forward from the vertical in the first display position and rings 78 are upright, or upright, in the second display position.

Figure 14A:
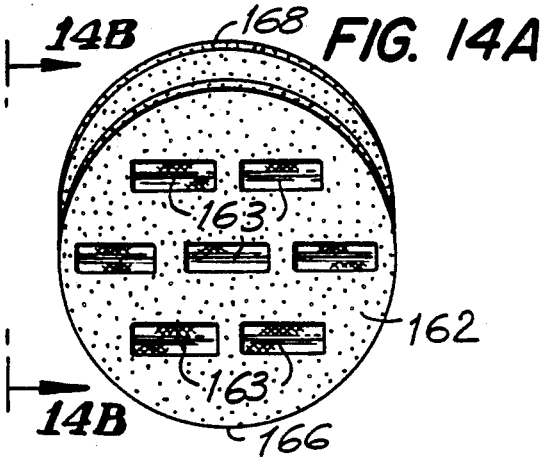
FIGS. 14A, 14B, 14C, and 14D show a unitary angled ring display system having first and second platforms configured as circles.
Figure 14B:
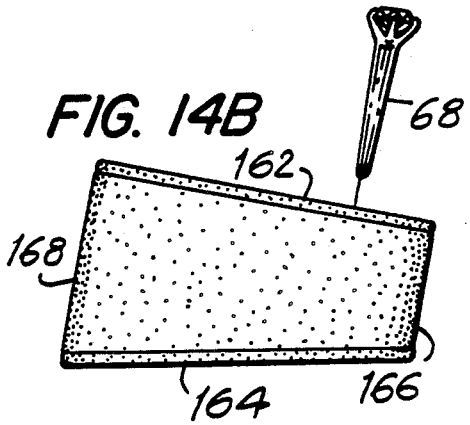
Figure 14C:
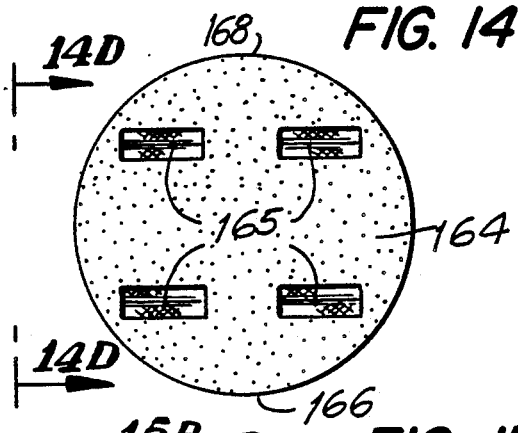
Figure 14D:
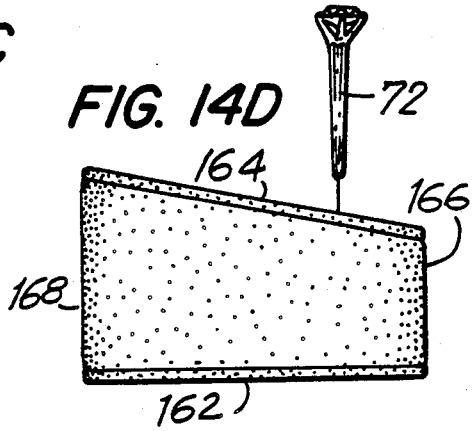

FIGS. 14A and 14C are top views of a first flat platform, or first flat surface, 162 having seven first ring slots 163 and a second flat platform, or second flat surface, 164 having three second ring slots 165. First and second flat surfaces 162 and 164 are configured as circles of a unitary angled ring display system having front and rear walls 166 and 168, respectively. Rear wall 168 is curved outwardly relative to front wall 166. First and second flat surfaces 162 and 164 define angles analogous to angles A and B, respectively, described with reference to first and second flat surfaces 68 and 74, respectively, of unitary angled ring system 62. Front and rear walls 166 and 168 shown in elevation views in FIGS. 14B and 14D are both at right angles to second flat surface 164. Cutouts of the base components are analogous to cutouts 104 of base 98 of FIG. 9, that is, the cutouts extend perpendicular to second flat surface 164 so that rings 72 are angled slightly forward from the vertical in the first display position and rings 78 are upright, or vertical, in the second display position.

Figure 15A:
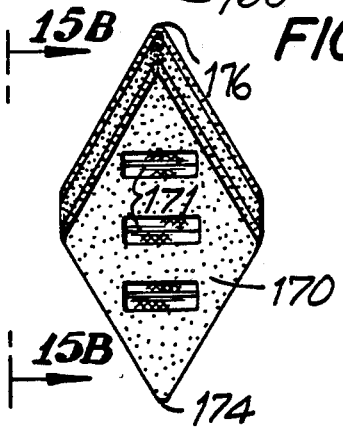
FIGS. 15A, 15B, 15C, and 15D show a unitary angled ring display system having first and second platforms configured as diamonds.
Figure 15B:
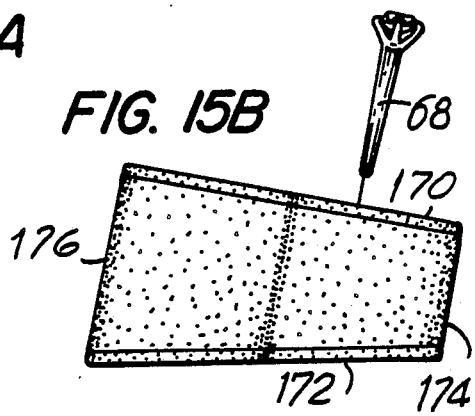
Figure 15C:
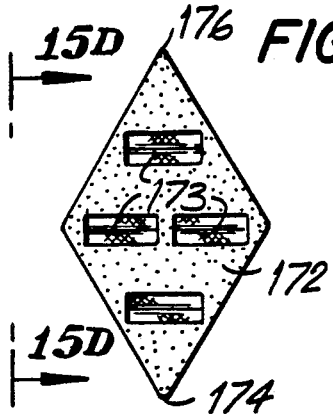
Figure 15D:
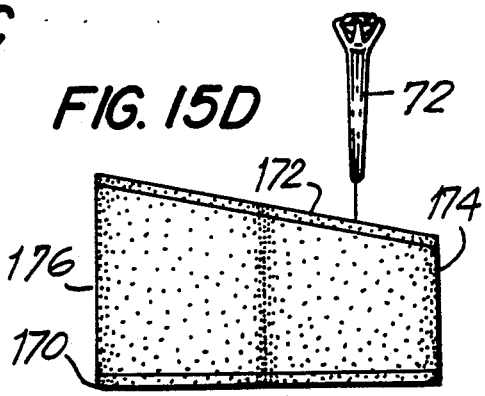

FIGS. 15A and 15C are top views of a first flat platforms, or first flat surfaces, 170 having three first ring slots 171 and a second flat platforms, or second flat surfaces, 172 having five second ring slots 173. First and second flat surfaces 170 and 172 are configured as diamonds, that is, a rhombus or square having the long diagonal extending in a downwardly direction, of a unitary angled ring display system having front and rear edges, 174 and 176, respectively. First and second flat surfaces 170 and 172 define angles analogous to angles A and B, respectively, described with reference to first and second flat surfaces 68 and 74, respectively, of unitary angled ring system 62. Front and rear edges 174 and 176 shown in elevation views in FIGS. 15B and 15D are both at right angles to second flat surface 172. Cutouts of the base components are analogous to cutouts 104 of base 98 of FIG. 9, that is, the cutouts extend perpendicular to second flat surface 172 so that rings 72 are angled slightly forward from the vertical in the first display position and rings 78 are upright, or vertical, in the second display position.

Figures 16A, 16B, 16C, 16D, 17A, 17B, 17C, 17D:
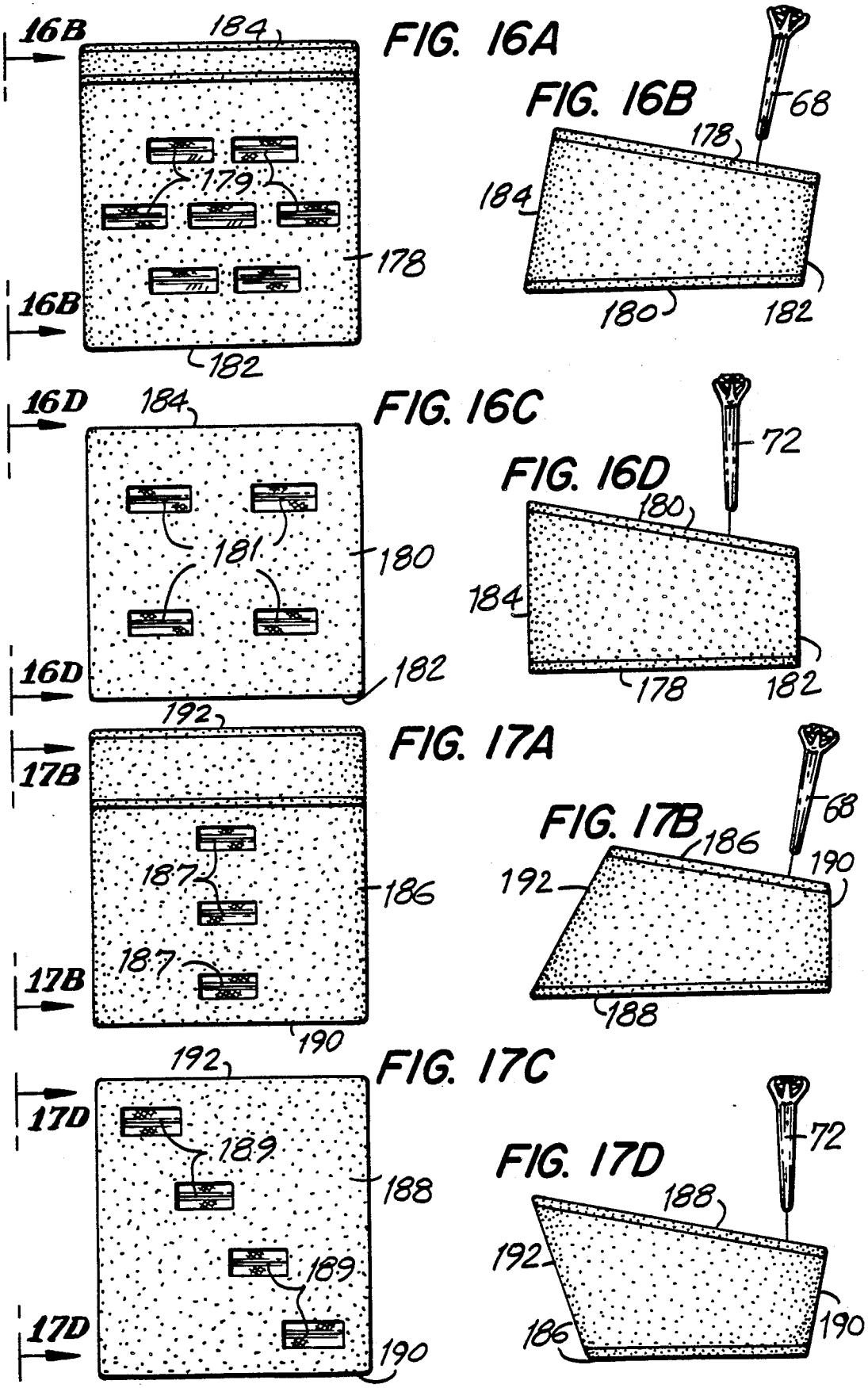
FIGS. 16A, 16B, 16C, and 16D show a unitary angled ring display system having first and second platforms configured as squares.
FIGS. 17A, 17b, 17C, and 17D show a unitary angled ring display system having first and second platform surfaces configured as squares and the rear wall being at an acute angle with the second platform surface.

FIGS. 16A and 16C are top views of a first platform, or first flat surface, 178 having four first ring slots 179 and a second platform, or second flat surface, 180 having five second ring slots 181. First and second flat surfaces 178 and 180 are configured as squares of a unitary angled ring display system having front and rear walls 182 and 184, respectively. First and second flat surfaces 178 and 180 define angles analogous to angles A and B, respectively, described with reference to first and second flat surfaces 68 and 74, respectively, of unitary angled ring system 62. Front and rear walls 182 and 184 shown in elevation views in views 16C and 16D are both at right angles to second flat surface 180. Cutouts of the base components are analogous to cutouts 104 of base 98 of FIG. 9, that is, the cutouts extend perpendicular to second flat surface 180 so that rings 72 are angled slightly forward from the vertical in the first display position and rings 78 are upright, or vertical, in the second display position.

FIGS. 17A and 17C are top views of a first flat platform, or first flat surface, 186 having three first ring slots 187 and a second flat platform, or second flat surface, 188 having four second ring slots 189. First and second flat surfaces 186 and 188 are configured as squares of a unitary angled ring display system having front and rear walls 190 and 192, respectively. First and second flat surfaces 186 and 188 define angles analogous to angles A and B, respectively, described with reference to first and second flat surfaces 68 and 74, respectively, of unitary angled ring system 62. Front wall 190 shown in elevation view in FIGS. 17B and 17D is at right angles to second flat surface 188, and rear wall 192 is at a non-right angle to second flat surface 188, the angle being an obtuse angle. Cutouts of the base components are analogous to cutouts 104 of base 98 of FIG. 9, that is, the cutouts extend perpendicular to second flat surface 188 so that rings 72 are angled slightly forward from the vertical in the first display position and rings 78 are upright, or vertical, in the second display position.

Figure 18A:
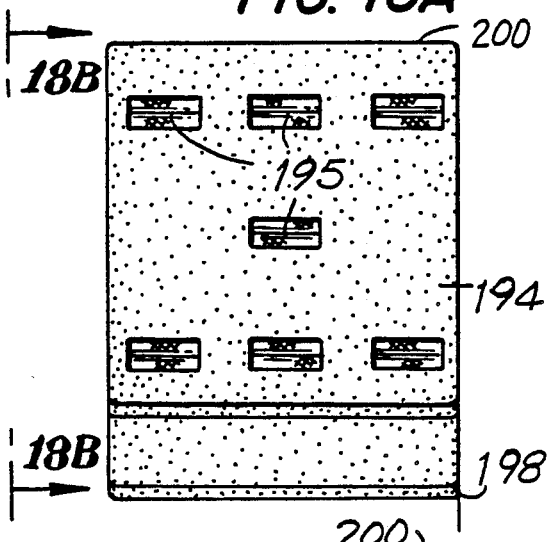
FIGS. 18A, 18B, 18C, and 18D show a unitary angled ring display system having first and second platform surfaces configured as rectangles with the front wall defining an acute angle with the second platform surface and the rear wall defining an obtuse angle with the second platform surface.
Figure 18B:
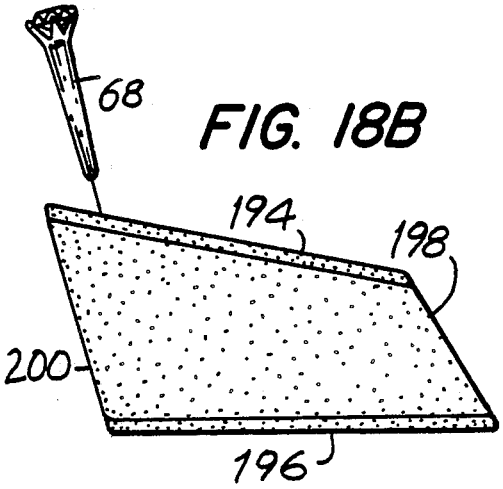
Figure 18C:
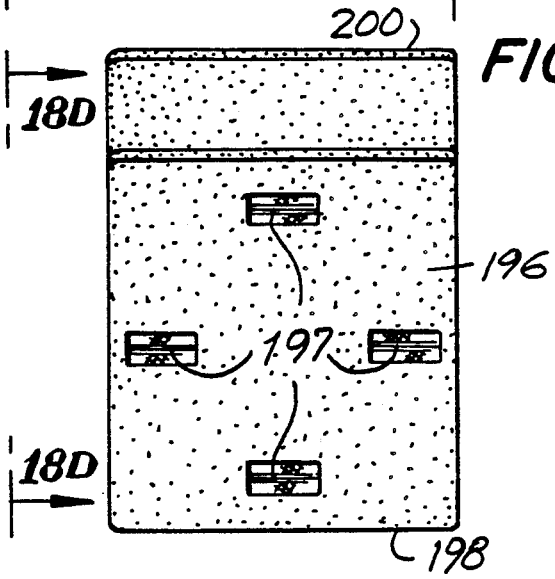
Figure 18D:
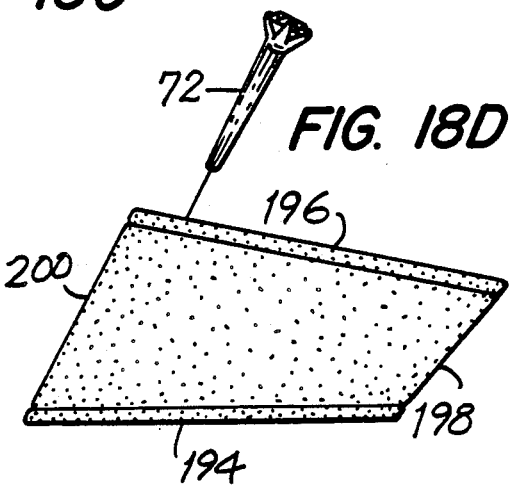

FIGS. 18A and 18C are top views of a first flat platform, or first flat surface, 194 having six first ring slots 195 and a second flat platform, or second flat surface, 196 having four second ring slots 197. First and second flat surfaces 194 and 196 are configured as rectangles of a unitary angled ring display system having front and rear walls 198 and 200, respectively, with the long dimension of the rectangles extending between front and rear walls 198 and 200. First and second flat surfaces 194 and 196 define angles analogous to angles A and B described with reference to first and second flat surfaces 68 and 74, respectively, of unitary angled ring system 62. Front and rear walls 198 and 200 shown in elevation views in FIGS. 18B and 18D are both at non-right angles to second flat surface 196; specifically, front and rear walls 198 and 200 are angled rearward from the vertical in the first display position of FIG. 18B and are angled forward from the vertical in the second display position of FIG. 18D. Cutouts of the base components are similar to cutouts 104 of base 98 of FIG. 9, except that the cutouts in the embodiment of FIGS. 18A–18D extend generally parallel to rear wall 200 so that rings 72 are angled slightly rearward from the vertical in the first display position and rings 78 extend slightly forward from the vertical in the second display position.

Figure 19A:
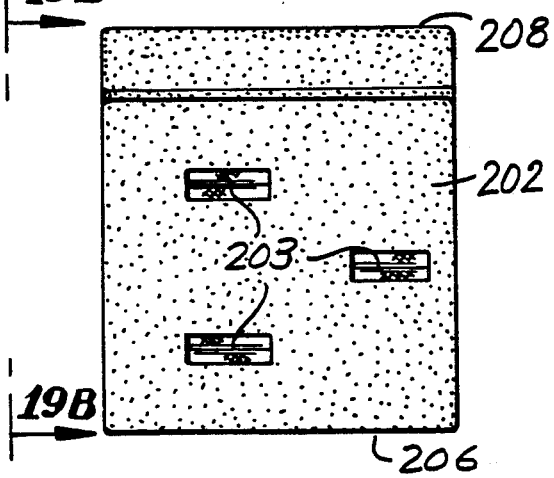
FIGS. 19A, 19B, 19C, and 19D show a unitary angled ring display system having first and second platform surfaces configured as squares with the rear wall being curved outwardly.
Figure 19B:
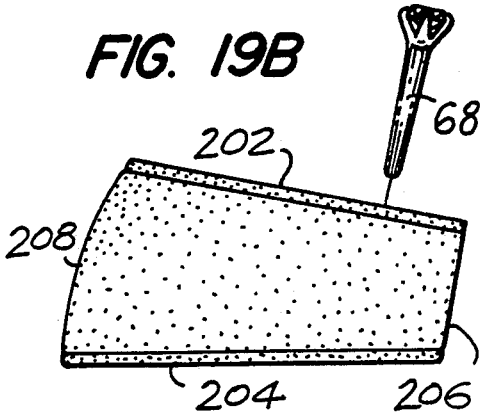
Figure 19C:
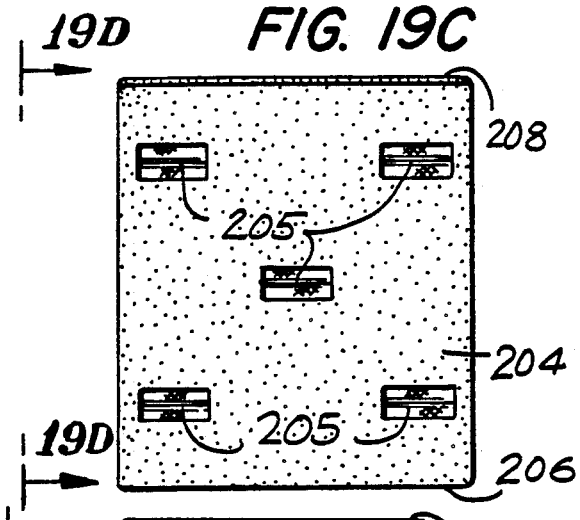
Figure 19D:
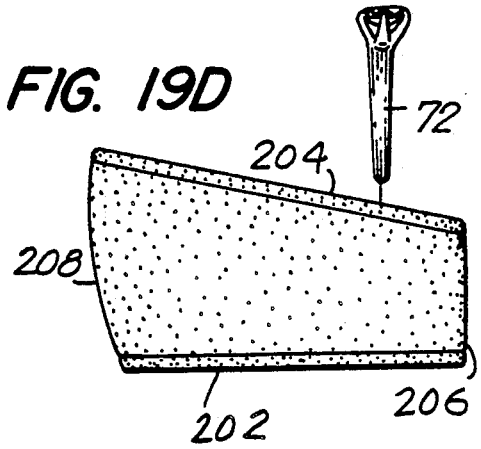

FIGS. 19A and 19C are top views of first flat platform, or first flat surface, 202 having three first ring slots 203 and a second flat platform, or second flat surface, 204 having five second ring slots 205. First and second flat surfaces 202 and 204 are configured as squares of a unitary angled ring display system having front and rear walls 206 and 208, respectively. First and second flat surfaces 202 and 204 define angles analogous to angles A and B described with reference to first and second flat surfaces 68 and 74, respectively, of unitary angled ring system 62. Front wall 214 shown in elevation view in FIGS. 19A and 19B is at right angles to second flat surface 204. Rear wall 208 is curved outwardly from front wall 206. Cutouts of the base components are analogous to cutouts 104 of base 98 of FIG. 9, that is, the cutouts extend perpendicular to second flat surface 202 so that rings 72 are angled slightly forward from the vertical in the first display position and rings 78 are upright, or vertical, in the second display position.

Figure 20A:
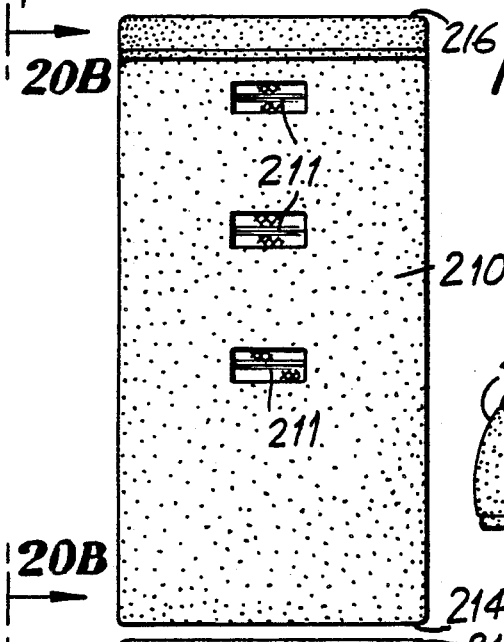
FIGS. 20A, 20B, 20C, and 20D shown a unitary angled ring display system having first and second platform surfaces configured as rectangles, meeting at a front edge, and having a curved rear wall.
Figure 20B:
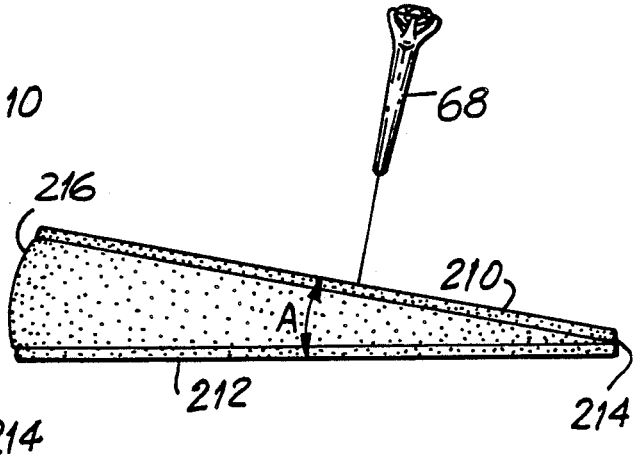
Figure 20C:
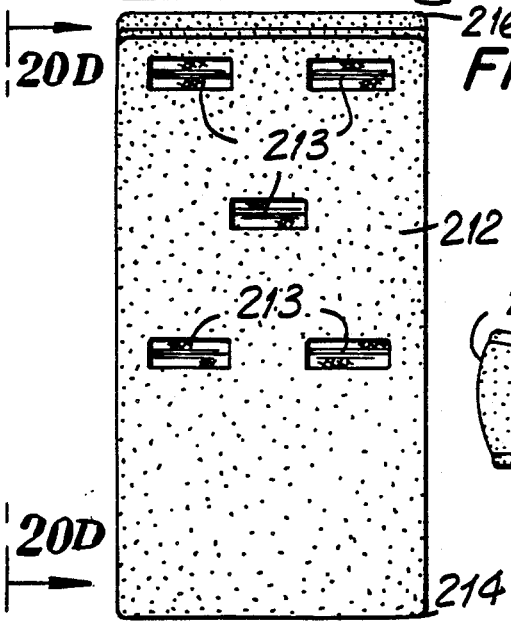
Figure 20D:
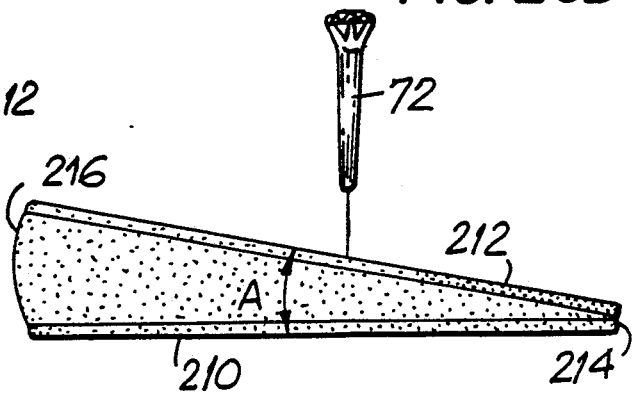

FIGS. 20A and 20C are top views of a first flat platform, or first flat surface, 210 having three first ring slots 211 and a second flat platform, or second flat surface, 212 having five second ring slots 213. First and second flat surfaces 210 and 212 are configured as rectangles of a unitary angled ring display system. First and second flat surfaces 210 and 212 define angles analogous to angles A and B described with reference to first and second flat surfaces 68 and 74, respectively, of unitary angled ring system 62. As shown in elevation views 20B and 20D first and second flat surfaces 210 and 212 meet so as to form an angle A at a front edge 214. A rear wall 216 opposed to front edge 214 is curved outwardly from front edge 214. The long dimension of the rectangles of first and second flat surfaces 194 and 196 extend between rear wall 216 and front edge 214. Cutouts of the base components are analogous to cutouts 104 of base 98 of FIG. 9, that is, the cutouts extend perpendicular to second flat surface 210 so that rings 72 are angled slightly forward from the vertical in the first display position and rings 78 are upright, or vertical, in the second display position.

Although the present invention has been described in some detail by way of illustration and example for purposes of clarity and understanding, it will, of course, be understood that various changes and modifications may be made in the form, details, and arrangements of the parts without departing from the scope of the invention set forth in the following claims.

What is claimed is:

1. A display system for showing rings on a generally horizontal shelf surface of a showcase, including, in combination, a support structure, said support structure including a first flat surface having a first plurality of ring slots for mounting a first plurality of the rings and a second flat surface having a second plurality of ring slots for mounting a second plurality of the rings, said support structure being movable between first and second display positions, said first display position being when said first flat surface is oriented facing upward for viewing and said second flat surface is oriented facing downward, and said second display position being when said second flat surface is oriented facing upward for viewing and said first flat surface is oriented facing downward, wherein in said first display position said second flat surface is positioned on the generally horizontal shelf surface and said first flat surface is aligned with a first flat plane which defines a first angle with the generally horizontal shelf surface, and wherein in said second display position said first flat surface is positioned on the generally horizontal shelf surface and said second flat surface is aligned with a second flat plane which defines a second angle with the generally horizontal shelf surface.

2. The display system according to claim 1, wherein the number of ring slots for said first plurality of ring slots is different than the number of ring slots for said second plurality of ring slots.

3. The display system according to claim 1, wherein the number of ring slots for said first plurality of ring slots and the number of ring slots for said second plurality of ring slots are the same.

4. The display system according to claim 1, wherein said first and second surfaces are configured as rectangles.

5. The display system according to claim 1, wherein said first and second surfaces are configured as squares.

6. The display system according to claim 1, wherein said first and second surfaces are configured as ovals.

7. The display system according to claim 1, wherein said first and second surfaces are configured as polygons.

8. The display system according to claim 7, wherein said polygons are configured as hexagons.

9. The display system according to claim 7, wherein said polygons are configured as octagons.

10. The display system according to claim 1, wherein said first and second surfaces are configured as rhombuses.

11. The display system according to claim 1, wherein said first and second surfaces are configured as diamonds.

12. The display system according to claim 1, wherein said first and second surfaces are configured as circles.

13. The display system according to claim 1, wherein said first angle and said second angle are equal.

14. The display system according to claim 1, wherein said support structure includes a continuous wall joined to the edges of said first and second surfaces.

15. The display system according to claim 14, wherein said continuous wall includes front and rear walls, said first and second surfaces being joined to said front and rear walls, said first or second flat surface being angled downward at said first or second angle from said rear wall to said front wall when said support structure is in said first or second display position.

16. The display system according to claim 15, wherein said front and rear walls are each at right angles to one of said first and second surfaces.

17. The display system according to claim 15, wherein one of said front or rear walls are at right angles to one of said first or second surfaces, said front and rear walls being in nonparallel relationship.

18. The display system according to claim 15, wherein said rear wall is generally perpendicular to said second flat surface.

19. The display system according to claim 15, wherein said rear wall is in a nonperpendicular orientation with said second flat surface.

20. The display system according to claim 15, wherein said rear wall is angled from the vertical rearward from said front wall.

21. The display system according to claim 15, wherein said rear wall is curved outwardly from said first and second angles.

22. The display system according to claim 1, wherein said support structure includes a base having opposed first and second sides aligned with said first and second flat surfaces, respectively, said base defining a plurality of parallel cutouts extending through said base and opening a said first and second sides, said first and second plurality of ring slots being located coextensively with said plurality of cutouts.

23. The display system according to claim 22, wherein said plurality of cutouts are generally parallel.

24. The display system according to claim 22, wherein said plurality of cutouts are generally parallel to said second flat surface.

25. The display system according to claim 22, wherein said plurality of cutouts are generally parallel to said rear wall.

26. The display system according to claim 22, further including first and second stiffening boards positioned over said first and second sides, respectively, of said base, said stiffening boards defining elongated holes aligned with said first and said second plurality of ring slots, wherein said plurality of cutouts are covered except in the areas of said first and said second plurality of ring slots; gripping means positioned in said plurality of cutouts in alignment with said first and second plurality of ring slots for removably holding said first or said second plurality of rings in said first or second plurality of ring slots, said gripping means including biasable grips defining gripping spaces capable of holding the first and said second plurality of rings in biased relationship when the first or said second plurality of rings is positioned in said first or said second plurality of ring slots; and a pair of spaced flexible blocks positioned in each cutout of said plurality of cutouts, said biasable grips being positioned between said pairs of blocks.

27. The display system according to claim 22, wherein said support structure further includes a fabric covering said base including said first and second stiffening boards.

28. The display system according to claim 26, wherein said biasable grips are configured as gripping strips for said first and said second plurality of ring slots, said gripping strips having adjacent inner sides located approximately midway through said plurality of cutouts, each biasable gripping strip for each of said pairs of said first and said second ring slots being in adjacent relationship at said inner sides and opening at said first and second ring slots, respectively, and further including a bottom wall connected to each said adjacent inner side, said bottom wall acting to stop the movement of rings mounted into either said first and said second ring slots.

29. The display system according to claim 28 wherein said biasable grips include first and second biasable grip strips opening in relationship with said first and second surfaces, respectively, said first and second grip strips extending entirely through each of said plurality of cutouts in adjacent relationship with one another.

30. The display system according to claim 1, wherein said support structure includes a covering fabric.

* * * * *